US007315137B2

(12) United States Patent
Chang et al.

(10) Patent No.: US 7,315,137 B2
(45) Date of Patent: Jan. 1, 2008

(54) METHOD AND APPARATUS FOR A CCFL DRIVING DEVICE

(75) Inventors: Ching-Chung Chang, Taipei (TW); Ho-Min Chung, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/286,765

(22) Filed: Nov. 23, 2005

(65) Prior Publication Data

US 2006/0267517 A1 Nov. 30, 2006

(30) Foreign Application Priority Data

May 25, 2005 (CN) ..... 2005 1 0073858

(51) Int. Cl.
*G05F 1/00* (2006.01)

(52) U.S. Cl. ..... 315/291; 315/246; 315/307; 315/308

(58) Field of Classification Search ..... 315/307–308, 315/291, 209 R, 86–88, 224, 312, 219, 246–247, 315/297
See application file for complete search history.

(56) References Cited

U.S. PATENT DOCUMENTS 4,862,038 A * 8/1989 Morten ..... 315/86
5,907,742 A 5/1999 Johnson et al. ..... 399/51
2002/0036608 A1* 3/2002 Hirakata et al. ..... 345/87
2002/0047639 A1* 4/2002 Okuchi et al. ..... 315/307
2002/0047643 A1* 4/2002 Takahashi et al. ..... 315/307
2003/0015971 A1* 1/2003 Bai ..... 315/291
2003/0160574 A1* 8/2003 Gray ..... 315/291
2005/0035726 A1* 2/2005 Muramatsu et al. ..... 315/291
2005/0088115 A1* 4/2005 Kimura et al. ..... 315/291
2006/0049777 A1* 3/2006 Kumagai et al. ..... 315/224
2006/0158132 A1* 7/2006 Jang ..... 315/209 R
2007/0138976 A1* 6/2007 Noda ..... 315/291

* cited by examiner

*Primary Examiner*—Haissa Philogene
*Assistant Examiner*—Tung X Le
(74) *Attorney, Agent, or Firm*—Quintero Law Office

(57) ABSTRACT

A driving device is provided for a cathode fluorescent lamp (CCFL) circuit, comprising a voltage generator outputting a driving voltage and a controller coupled thereto. The controller directs the voltage generator to output a first voltage exceeding a working voltage of the CCFL to initialize the CCFL. When brightness of the cold cathode lamp tube exceeds a working brightness of the CCFL, the controller directs the voltage generator to decrease the driving voltage gradually so that the brightness of the CCFL equals the working brightness. The controller stops decreasing the driving voltage when the driving voltage equals the working voltage.

21 Claims, 3 Drawing Sheets

METHOD AND APPARATUS FOR A CCFL DRIVING DEVICE

BACKGROUND

The invention is related to a driving device of a cold cathode fluorescent lamp (CCFL), and more particularly, to a driving device of a CCFL that quickly provides stable working illumination.

CCFLs are widely used in electronic devices such as scanners, LCD panels, notebook PCs and LCD televisions. Conventionally a CCFL circuit receives a static voltage equaling a working voltage of the CCFL. The CCFL may take as long as about three minutes after power supply is initialized to reach required functional illumination due to mercury vaporization in the CCPL not being sufficient at low temperatures, requiring the CCFL to warm up.

A driving method is disclosed by Johnson, et al. (U.S. Pat. No. 5,907,742, "Lamp control scheme for rapid warm-up of fluorescent lamp in office equipment"), in which a lamp is overdriven by high current within a predetermined time limit to accelerate mercury vaporization. The drive current is then reduced to a normal level. Scanner light output is monitored by a sensor circuit, and the system waits until the light output reaches a minimum and the light profile is sufficiently stable. The scanner is then calibrated to a white reference, and the closed loop control of the signal level is activated.

FIG. 1A shows a voltage vs. time relationship of a CCFL circuit according to Johnson's patent. FIGS. 1B-1D show illumination vs. time relationships of the CCFL associated with FIG. 1A, which shows a first voltage exceeding a working voltage of CCFL delivered to a CCFL circuit. The delivery period of the first voltage is from time 0 to time B. FIGS. 1B-1D show initialization and illumination rise of CCFL when the first voltage is provided. The illumination of the CCFL exceeds a working illumination at time A. Since the CCFL circuit receives the first voltage exceeding the working voltage of the CCFL, the temperature of the CCFL does not yet exceed a working temperature of the CCFL. Since the first voltage is still provided, the temperature of the CCFL, and in turn the illumination of the CCFL, continue to rise.

At time B, the working voltage of CCFL is provided. If the temperature of CCFL equals the working temperature of the CCFL at this time, the illumination transient of the CCFL is as shown in FIG. 1B. If the temperature of CCFL exceeds the working temperature of the CCFL at this time, the illumination transient of the CCFL is as shown in FIG. 1C; the illumination of CCFL decreases gradually to the working illumination with the temperature of the CCFL. If the temperature of CCFL is lower than the working temperature of the CCFL at this time, the illumination transient of the CCFL is as shown in FIG. 1D; the illumination of CCFL increases gradually to the working illumination with the temperature of CCFL.

Although Johnson provides faster warm-up of the CCFL, when the illumination exceeds the working illumination, as illustrated at time A in FIGS. 1B-1D, the CCFL is still not ready, since the illumination increases until at least time C. Additionally, if the period supplying the first voltage is fixed, illumination of the CCFL may still be higher or lower than the working illumination and not stable when the working voltage is provided, as illustrated at time C of FIG. 1C-1D.

SUMMARY

A driving device is provided for a CCFL circuit, comprising a voltage generator outputting the driving voltage and a controller coupled to the voltage generator. The controller directs the voltage generator to output a first voltage exceeding a working voltage of the CCFL to initialize the CCFL. When brightness of the CCFL tube exceeds a working brightness, the controller controls the voltage generator to decrease the driving voltage gradually so that the brightness of the CCFL stays in the working brightness. The controller stops decreasing the driving voltage when the driving voltage is decreased to the working voltage.

The invention further provides an electronic device with a light source, comprising a CCFL circuit comprising at least one CCFL, and a driving device coupled to the CCFL circuit. The driving device comprises a power supply outputting the driving voltage to the CCFL circuit, and a controller coupling to the power supply, directing the power supply to output a first voltage exceeding a working voltage of the CCFL, when initializing the CCFL; directing the power supply to decrease the output voltage gradually, when the illumination of the CCFL exceeds a working illumination of the CCFL; and directing the power supply to stop decreasing the output voltage, when the output voltage substantially equals the working voltage of the CCFL.

The invention further provides a method of providing a driving voltage to a CCFL circuit with at least one CCFL, comprising providing a first voltage exceeding a working voltage of the CCFL as the driving voltage to the CCFL circuit to initialize the CCFL; decreasing the output voltage gradually, when the illumination of the CCFL exceeds a working illumination of the CCFL; and stopping decreasing the output voltage, when the output voltage substantially equals the working voltage of the CCFL.

Additional features and advantages of the invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE DRAWINGS

The accompanying drawings, which are incorporated in and constituting a part of this specification, illustrate embodiments of the invention and, together with the description, serve to explain the features, advantages, and principles of the invention.

DETAILED DESCRIPTION

Figure 1A:
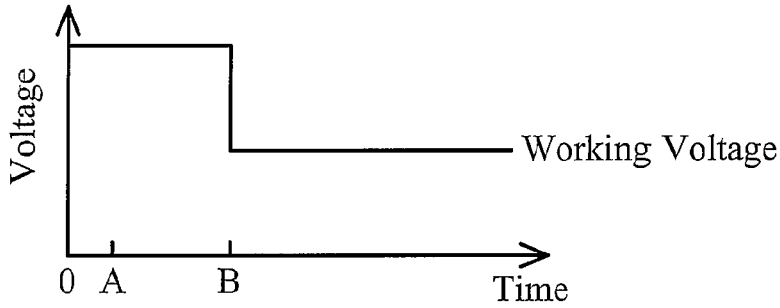
FIG. 1A (PRIOR ART)
FIG. 1A shows a voltage vs. time relationship of a CCFL circuit according to U.S. Pat. No. 5,907,742.
Figure 1B:
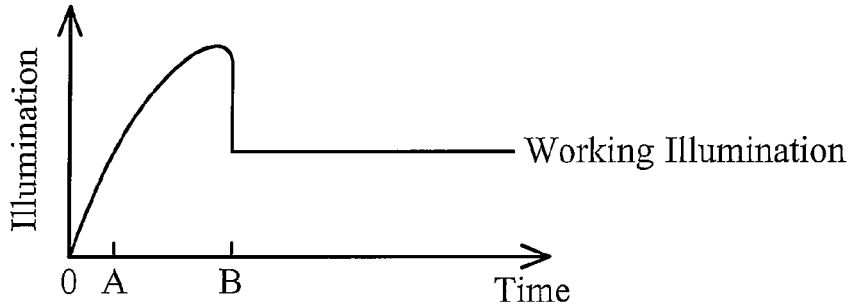
FIG. 1B (PRIOR ART)
FIGS. 1B-1D show illumination vs. time relationships of a CCFL associated with FIG. 1A.
Figure 1C:
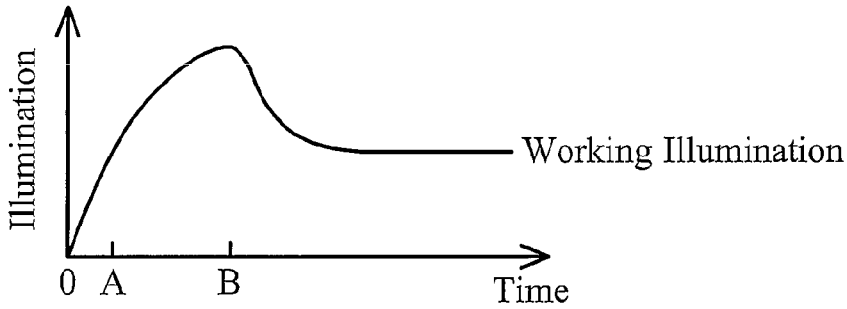
FIG. 1C (PRIOR ART)
Figure 1D:
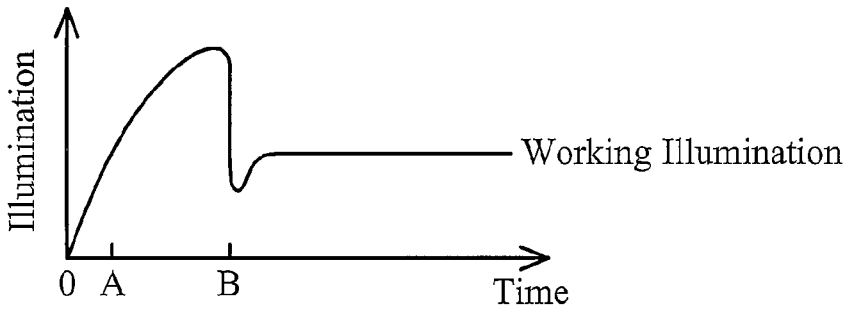
FIG. 1D (PRIOR ART)
Figure 2:
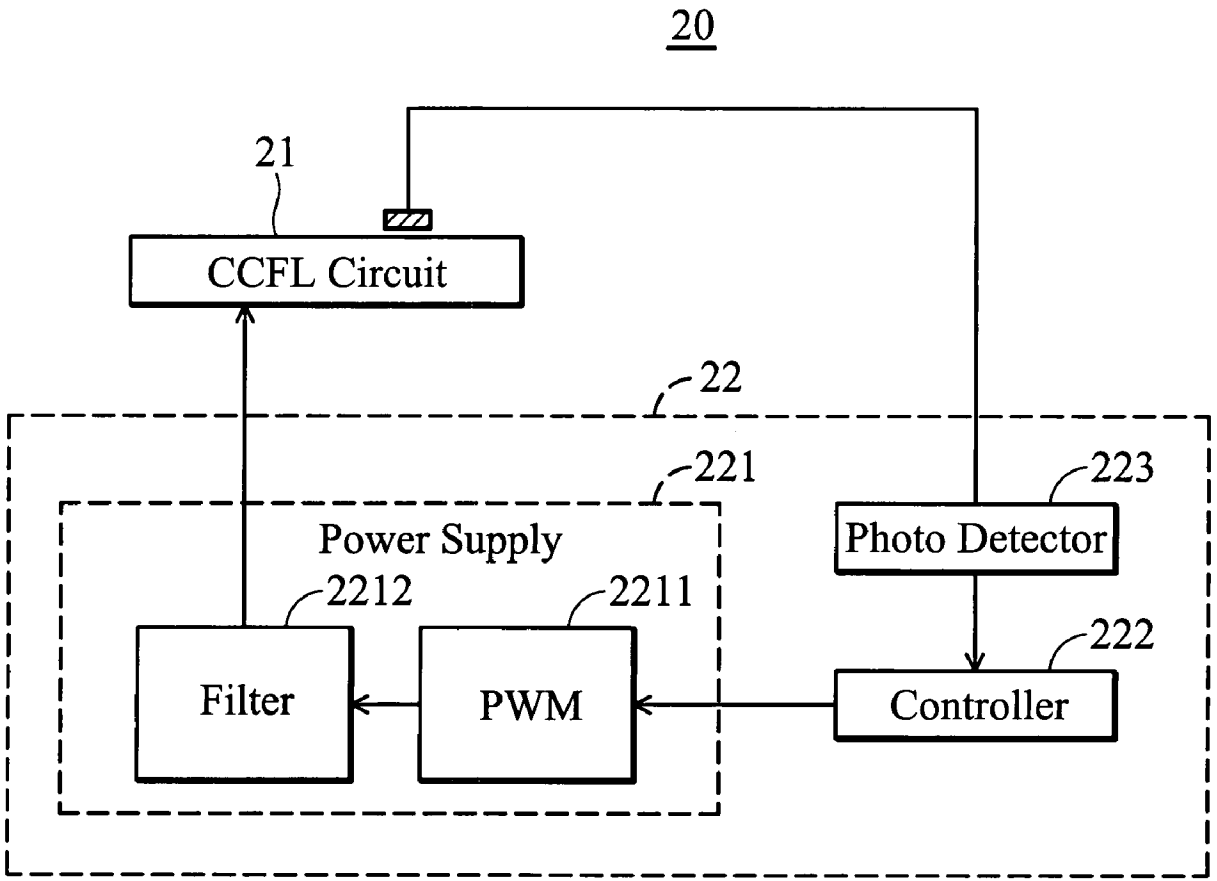
FIG. 2 is a block diagram of an electronic device according to an embodiment of the invention.

FIG. 2 is a block diagram of an electronic device 20 according to an embodiment of the invention. Electronic device 20 comprises a light source using CCFL. Electronic device 20 may be a scanner, an LCD panel, a notebook PC or an LCD television, etc. Electronic device 20 comprises a CCFL circuit 21 and a driving device 22 coupled thereto. CCFL circuit 21 comprises at least one CCFL.

Driving device 22 comprises a power supply 221 outputting a driving voltage to CCFL circuit 21, and a controller 222 coupled to the power supply 221.

Figure 3A:
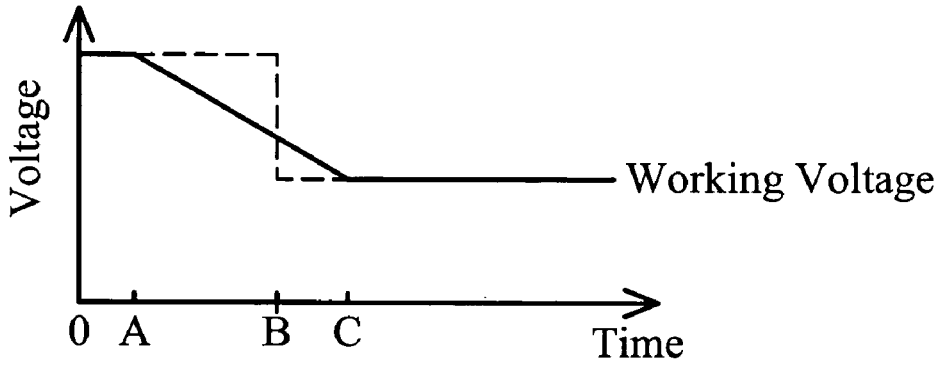
FIGS. 3A and 3B illustrate voltage and illumination vs. time relationships of a CCFL in the electronic device of FIG. 2.
Figure 3B:
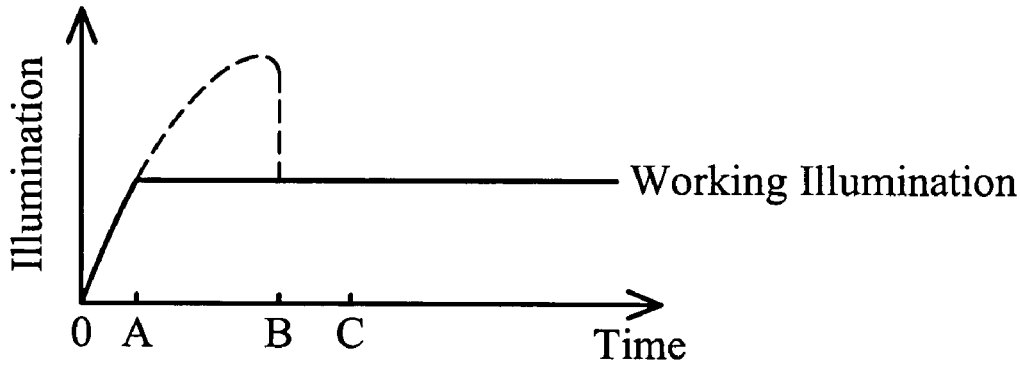

FIGS. 3A and 3B illustrate voltage and illumination vs. time relationships of the CCFL circuit 21 in electronic device 20 of FIG. 2.

When initializing the CCFL, controller 222 directs the power supply 221 to output a first voltage exceeding a working voltage of the CCFL circuit 21, as shown in FIG. 3A from time 0. The CCFL is initialized and the temperature of the CCFL rises. The illumination of the CCFL increases as shown in FIG. 3B.

At time A, the illumination of the CCFL exceeds a working illumination. The temperature of the CCFL is still lower than a working temperature of the CCFL at this time. Since the driving voltage is higher than the working voltage of the CCFL, the illumination of the CCFL still increases. Controller 222 starts to direct the power supply 221 to decrease the output driving voltage, as illustrated in FIG. 3A from time A. The ratio to decrease the driving voltage must refer to the temperature increase of the CCFL, so that the illumination of the CCFL stays within the range of working illumination.

At time C, the driving voltage substantially equals the working voltage of the CCFL circuit 21. Controller 222 directs the power supply 221 to stop the voltage decrease. The temperature of the CCFL equals the working temperature of the CCFL at this time, and the CCFL circuit is stable for normal function.

Providing a first voltage exceeding working voltage as the driving voltage from time 0 to time A initializes the CCFL and directs the illumination of the CCFL to increase to exceed the working illumination. After time A, controller 222 may direct the power supply 221 to decrease the output driving voltage by degrees of voltage. Degrees of voltage may be set by a fixed voltage level. The fixed level of voltage and the period to decrease a degree of the driving voltage may be acquired when designing the electronic device 20, or set manually by user according to the environment. Driving device 22 may further comprise a photo detector 223 detecting illumination of the CCFL. The controller 222 may direct the power supply to decrease the output driving voltage when the detected illumination exceeds the working illumination of the CCFL.

Power supply 221 may comprise a pulse width modulator (PWM) 2211 outputting a waveform, and a filter 2212 receiving the waveform and outputting the driving voltage. The filter 2212 converts the waveform to various DC voltage levels according to the duty cycle of the waveform controlled by controller 222.

In this embodiment, CCFL is initialized and in the range of working illumination at time A, and the electronic device 20 is ready for function. The dashed lines in FIGS. 3A and 3B illustrate the difference between U.S. Pat. No. 5,907,742 and the invention. The device is not ready for function until time B in U.S. Pat. No. 5,907,742. The invention provides techniques to quickly provide stable working illumination, and an electronic device thereof can be ready for function in a short time after powering up.

While the invention has been described by way of example and in terms of preferred embodiment, it is to be understood that the invention is not limited thereto. Those skilled in this technology can still make various alterations and modifications without departing from the scope and spirit of this invention. Therefore, the scope of the present invention shall be defined and protected by the following claims and their equivalents.

What is claimed is:

1. A driving device providing a driving voltage to a cold cathode fluorescent lamp (CCFL) circuit with at least one CCFL, comprising:

a power supply outputting the driving voltage;

a controller coupled to the power supply and directing the power supply to output a first voltage exceeding a working voltage of the CCFL, when initializing the CCFL;

directing the power supply to decrease the output voltage gradually by a fixed voltage level, when the illumination of the cold cathode lamp tube exceeds a working illumination of the CCFL; and directing the power supply to stop decreasing the output voltage, when the output voltage substantially equals the working voltage of the CCFL.

2. The driving device as claimed in claim 1, wherein the controller directs the power supply to output the first voltage for a first period, such that the CCFL exceeds the working illumination.

3. The driving device as claimed in claim 2, wherein the controller directs the power supply to decrease the output voltage gradually in a predetermined way after the first period, until the output voltage substantially equals the working voltage of the CCFL.

4. The driving device as claimed in claim 3, wherein the controller directs the power supply to decrease by degrees of voltage.

5. The driving device as claimed in claim 1, further comprising a photo detector detecting the illumination of the CCFL, coupled to the controller; wherein the controller directs the power supply to decrease the output voltage when the detected illumination exceeds the working illumination.

6. The driving device as claimed in claim 1, wherein the power supply comprises:

a pulse width modulator (PWM) outputting a waveform with a duty cycle controlled by the controller; and a filter receiving the waveform and outputting the driving voltage.

7. An electronic device, comprising:

a CCFL circuit comprising at least one CCFL;

a driving device coupled to the CCFL circuit, comprising:

a power supply outputting the driving voltage to the CCFL circuit;

a controller coupling to the power supply and directing the power supply to output a first voltage exceeding a working voltage of the CCFL, when initializing the CCFL;

directing the power supply to decrease the output voltage gradually by a fixed voltage level, when the illumination of the CCFL exceeds a working illumination of the CCFL; and directing the power supply to stop decreasing the output voltage, when the output voltage substantially equals the working voltage of the CCFL.

8. The electronic device as claimed in claim 7, wherein the controller directs the power supply to output the first voltage for a first period, such that the CCFL exceeds the working illumination.

9. The electronic device as claimed in claim 8, wherein the controller directs the power supply to decrease the output voltage gradually in a predetermined way after the first period, until the output voltage substantially equals the working voltage of the CCFL.

10. The electronic device as claimed in claim 9, wherein the controller directs the power supply to decrease by degrees of voltage.

11. The electronic device as claimed in claim 7, wherein the driving device further comprises a photo detector detecting the illumination of the CCFL, coupled to the controller; wherein the controller directs the power supply to decrease the output voltage when the detected illumination exceeds the working illumination.

12. The electronic device as claimed in claim 7, wherein the power supply of the driving device comprises:

a pulse width modulator (PWM) outputting a waveform with a duty cycle controlled by the controller; and a filter receiving the waveform and outputting the driving voltage.

13. The electronic device as claimed in claim 7, wherein the electronic device is a scanner.

14. The electronic device as claimed in claim 7, wherein the electronic device is an LCD monitor.

15. The electronic device as claimed in claim 7, wherein the electronic device is a notebook PC.

16. The electronic device as claimed in claim 7, wherein the electronic device is a LCD television.

17. A method of providing a driving voltage to a CCFL circuit with at least one CCFL, comprising:

providing a first voltage exceeding a working voltage of the CCFL as the driving voltage to the CCFL circuit to initialize the CCFL;

decreasing the output voltage gradually by a fixed voltage level, when the illumination of the CCFL exceeds a working illumination of the CCFL; and stopping decreasing the output voltage, when the output voltage substantially equals the working voltage of the CCFL.

18. The method as claimed in claim 17, wherein the first voltage is output for a first period, such that the illumination of the CCFL exceeds the working illumination of the CCFL.

19. The method as claimed in claim 18, further comprising decreasing the driving voltage gradually in a predetermined way after the first period, until the output voltage substantially equals the working voltage of the CCFL.

20. The method as claimed in claim 19, wherein the driving voltage is decreased by degrees of voltage.

21. The method as claimed in claim 17, further comprising detecting the illumination of the CCFL and decreasing the driving voltage when the illumination of the CCFL exceeds the working illumination of the CCFL.

* * * * *